US009363874B2

(12) United States Patent
Jeong et al.

(10) Patent No.: US 9,363,874 B2
(45) Date of Patent: Jun. 7, 2016

(54) CURRENT CONTROLLING DEVICE AND ELECTRIC FIELD EMISSION SYSTEM INCLUDING THE SAME

(71) Applicant: Electronics and Telecommunications Research Institute, Daejeon (KR)

(72) Inventors: Jin Woo Jeong, Daejeon (KR); Yoon-Ho Song, Daejeon (KR); Jun Tae Kang, Daegu (KR); Jae-woo Kim, Daejeon (KR); Sungyoul Choi, Ulsan (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 354 days.

(21) Appl. No.: 13/846,668

(22) Filed: Mar. 18, 2013

(65) Prior Publication Data

US 2013/0271037 A1 Oct. 17, 2013

(30) Foreign Application Priority Data

Apr. 12, 2012 (KR) ..... 10-2012-0037876
Nov. 28, 2012 (KR) ..... 10-2012-0136141

(51) Int. Cl.
*H05B 41/36* (2006.01)
*H05B 41/14* (2006.01)

(52) U.S. Cl.
CPC ..... *H05B 41/36* (2013.01); *H05B 41/14* (2013.01)

(58) Field of Classification Search
None
See application file for complete search history.

(56) References Cited

U.S. PATENT DOCUMENTS 5,525,868 A * 6/1996 Browning ..... G09G 3/22 315/169.1
8,461,775 B2 * 6/2013 Choutov et al. ..... 315/291
2011/0285302 A1 * 11/2011 Choutov et al. ..... 315/207
2011/0285312 A1 * 11/2011 Choutov et al. ..... 315/291

FOREIGN PATENT DOCUMENTS

JP 06130909 A * 5/1994 ..... G09G 3/20
KR 10-0885188 B1 2/2009

* cited by examiner

*Primary Examiner* — Long Nguyen

(57) ABSTRACT

Provided is a current controlling device for controlling an electric field emission current in connection with an electric field emission device which emits electrons in response to an applied voltage, the device including: a first current controlling transistor forming a current path in response to a first gate voltage; a second current controlling transistor connected between the field emission device and the first current controlling transistor and forming a current path in response to a second gate voltage; and a control logic controlling the first and second gate voltages, wherein the control logic controls a upper limit of the field emission current by using the first gate voltage.

20 Claims, 7 Drawing Sheets

CURRENT CONTROLLING DEVICE AND ELECTRIC FIELD EMISSION SYSTEM INCLUDING THE SAME

CROSS-REFERENCE TO RELATED APPLICATIONS

This U.S. non-provisional patent application claims priority under 35 U.S.C. §119 of Korean Patent Application No. 10-2012-0136141, filed on Nov. 28, 2012, and No. 10-2012-0037876, filed on Apr. 12, 2012, the entire contents of which are hereby incorporated by reference.

BACKGROUND OF THE INVENTION

The present invention disclosed herein relates to a current controlling device and an electric field emission system including the same.

An electric field emission device includes a cathode where an electric field emitting source (an emitter) emitting electrons is formed. When an electric field is applied to the cathode of the field emission device, the electrons emitted from the emitter are attracted to an anode. The electric field applied to the cathode is determined by an anode voltage in a dipole structure, or a gate voltage in a three-pole structure.

For stable driving, a current flowing through the electric field emission device is required to be constantly controlled. There is a method of controlling a voltage applied to the electric field emission device in order to control the current of the field emission device. However, the current of the electric field emission device increases exponentially in response to the applied voltage. Also, since a characteristic of the emitter of the electric field emission device may be degraded or activated over time, a current emitted for an identical voltage may decrease or increase. Accordingly, it is typically difficult to control an electric field emission current to be constant by using a voltage applied to an electric field emission device. For stable driving of the electric field emission device, a technique is required to control the field emission current to be constant without controlling an applied voltage.

SUMMARY OF THE INVENTION

The present invention provides a current controlling device and an electric field emission system including the same, capable of controlling an electric field emission current of the electric field emission system to be constant. More particularly, the current controlling device according the present invention directly controls a current which flows through a cathode of the field emission device using a plurality of transistors connected in series to the cathode.

Embodiments of the present invention provide current controlling devices for controlling an electric field emission current in connection with an electric field emission device which emits electrons in response to an applied voltage, the devices including: a first current controlling transistor forming a current path in response to a first gate voltage; a second current controlling transistor connected between the field emission device and the first current controlling transistor and forming a current path in response to a second gate voltage; and a control logic controlling the first and second gate voltages, wherein the control logic controls a upper limit of the field emission current by using the first gate voltage.

In some embodiments, the current controlling device may be driven under a condition that the applied voltage is provided with a value equal to or greater than a reference voltage; and the reference voltage may induce an electric field emission current equal to or greater than the upper limit of the field emission current from the field emission device.

In other embodiments, the current controlling device may be driven under a condition that the applied voltage is provided with a value equal to or lower than an upper limit voltage; and the upper limit voltage may be determined on the basis of a characteristic of the field emission device and an allowable drain-source voltage of the second current controlling transistor.

In still other embodiments, the control logic may control the second gate voltage for the second current controlling transistor to be constantly in a turn-on state.

In even other embodiments, the control logic may control the second gate voltage to maintain the second gate voltage to be constant and higher than the first gate voltage.

In yet other embodiments, the control logic may control the second gate voltage to cause the first current controlling transistor to operate in a saturated region.

In further embodiments, the second current controlling transistor may be a power metal oxide semiconductor field-effect transistor (Power MOSFET).

In still further embodiments, the first current controlling transistor may be a depletion mode Power MOSFET or an enhance mode Power MOSFET.

In other embodiments of the present invention, electric field emission systems include: an electric field emission device including a cathode for emitting electrons in response to an applied voltage; and a current controlling device connected to the field emission device and controlling an electric field emission current, wherein the current controlling device includes: a first current controlling transistor forming a current path in response to a first gate voltage; a second current controlling transistor connected between the cathode and the first current controlling transistor and forming a current path in response to a second gate voltage; and a control logic controlling the first and second gate voltages, wherein the control logic controls a upper limit of the field emission current by using the first gate voltage.

In some embodiments, the field emission device may further include an anode receiving electrons; and the electrons are emitted according to a voltage difference between the anode and the cathode.

In other embodiments, the anode may include a fluorescent body for generating a light, and may generate the light according to the received electrons.

In still other embodiments, the anode may generate X-rays according to the received electrons.

In even other embodiments, the field emission device may further includes: an anode receiving electrons; and a gate located between the anode and the cathode and inducing electron emission, and wherein the electrons may be emitted according to a voltage difference between the gate and the cathode.

In yet other embodiments, the field emission device may further include a focusing electrode focusing the electrons emitted from the cathode, and the focusing electrode may be located between the gate and the anode.

In further embodiments, the applied voltage may be provided to be equal to or higher than a reference voltage; and the reference voltage may induce an electric field emission current equal to or greater than the upper limit of the field emission current from the field emission device.

In still further embodiments, the applied voltage may be provided to be equal to or lower than an upper limit voltage; and the upper limit voltage may be determined on the basis of a characteristic of the field emission device and an allowable drain-source voltage of the second current controlling transistor.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
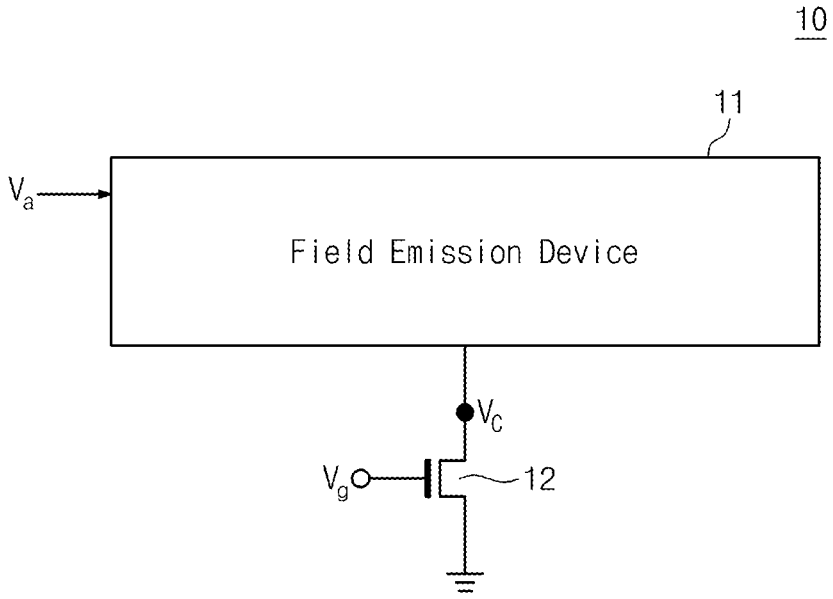
FIG. 1 is a block diagram illustrating a electric field emission system.

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

In the drawings, the dimensions of layers and regions are exaggerated for clarity of illustration. Like reference numerals refer to like elements throughout.

Hereinafter, it will be described about an exemplary embodiment of the present invention in conjunction with the accompanying drawings.

FIG. 1 is a block diagram illustrating an electric field emission system. Referring to FIG. 1, an electric field emission system 10 includes an electric field emission device 11 and a current controlling transistor 12.

The field emission device 11 includes a cathode for emitting electrons. The field emission device 11 is provided with an applied voltage $V_a$ for generating an electric field. In the field emission device 11 having a dipole structure, an applied voltage $V_a$ may be applied to an anode. Alternatively, in the field emission device 11 having a triple pole structure, the applied voltage $V_a$ may be applied to a gate.

When a voltage difference equal to or greater than a predetermined value is generated between an anode, or a gate in a case of the three-pole structure, and an emitter, electrons are emitted from the emitter of the cathode by tunneling. A voltage difference between the applied voltage and the cathode, which is necessary for the electrons to be emitted from the cathode, is defined as an electric field emission voltage $V_{ac}$.

The current controlling transistor 12 is connected to the cathode of the field emission device 11 and directly controls an electric field emission current of the field emission device 11. The current controlling transistor 12 may be a metal oxide semiconductor field-effect transistor (MOSFET).

Referring to FIG. 1, the drain of the current controlling transistor 12 is connected to the cathode of the field emission device 11, and the source is connected to the ground. The gate of the current controlling transistor 12 is provided with a gate voltage $V_g$.

A drain-source current of the current controlling transistor 12 may be controlled by the gate voltage $V_g$. The same current as the drain-source current of the current controlling transistor 12 has to flow through the field emission device 11 connected in series with the current controlling transistor 12. Accordingly, when the drain-source current is controlled by the current controlling transistor 12, a potential of the cathode voltage $V_c$ of the field emission device 11 changes and the current emission current may be controlled.

Figure 2:
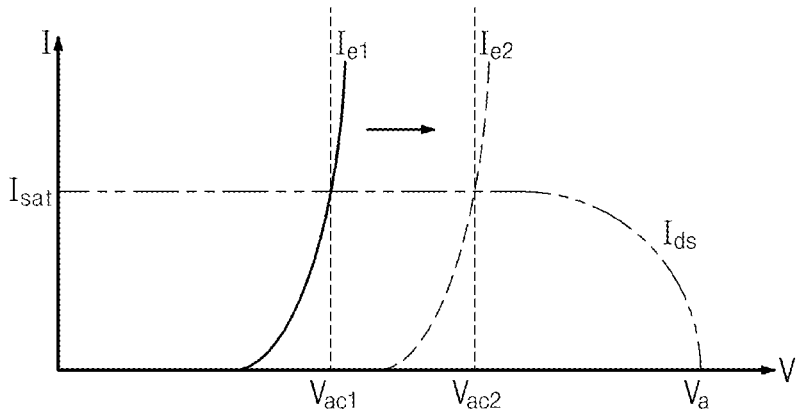
FIG. 2 is a graph illustrating a method of controlling an electric field emission current of a electric field emission system.

FIG. 2 is a graph illustrating a method for controlling an electric field emission current of the electric field emission system of FIG. 1. In FIG.2, a horizontal axis denotes a voltage and a vertical axis denotes a current.

Referring to the block diagram of FIG. 1, the applied voltage $V_a$ of the field emission device 11 is distributed to an electric field emission voltage $V_{ac}$ of the field emission device 11 and a drain-source voltage $V_{ds}$ of the current controlling transistor (see reference numeral 12 of FIG. 1). Since $V_a$ has a constant value, $V_{ac}$ and $V_{ds}$ have a negative correlation.

An initial field emission current $I_{e1}$ of the field emission device (see reference numeral 11 of FIG. 1) for the field emission voltage $V_{ac}$ of the field emission device 11 is the same as illustrated. The initial field emission current $I_{e1}$ increases exponentially when $V_{ac}$ becomes equal to or greater than a predetermined threshold voltage.

In a state where the gate voltage $V_g$ of the current controlling transistor 12 is constant, an ideal drain-source current $I_{ds}$ of the current controlling transistor 12 for $V_{ac}$ is the same as illustrated.

A saturated current $I_{sat}$ of the drain-source current $I_{ds}$ is determined on the basis of the gate voltage $V_g$.

Since the field emission device 11 and the current controlling transistor 12 are connected in series, an initial field emission current $I_{e1}$ and the drain-source current $I_{ds}$ are necessary to have the same value.

Accordingly, the field emission current of the electric field emission system 10 becomes the saturated current $I_{sat}$ of the drain-source current $I_{ds}$, and the value may be adjusted using the gate voltage $V_g$.

Meanwhile, as described above, when the emitter of the field emission device 11 becomes degraded, an electric field emission current function for $V_{ac}$ may change and exhibit a curve shape of a degraded field emission current $I_{e2}$.

However, due to the saturation characteristic of the current controlling transistor 12, the degraded field emission current $I_{e2}$ also becomes to have a value of the saturated current $I_{sat}$ of the drain-source current $I_{ds}$. Accordingly, the electric field emission system 10 of FIG. 1 may maintain the field emission to be current constant despite of the degradation of the field emission device 11.

However, the graph of FIG. 2 is about an ideal case. An actual saturated current $I_{sat}$ of the current controlling transistor 12 is not maintained to be constant.

Hereinafter, more detailed description is provided.

Figure 3:
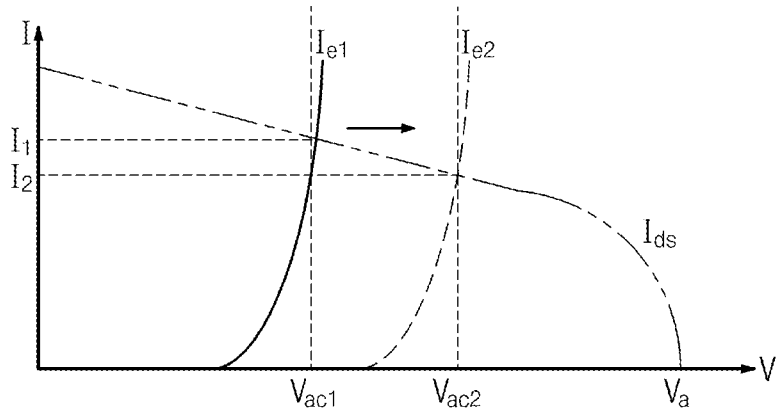
FIG. 3 is a graph re-illustrating the graph of FIG. 2 in consideration of an operation of an actual current controlling transistor.

FIG. 3 is a graph re-illustrating the graph of FIG. 2 in consideration of the operation of an actual current controlling transistor 12. The same as FIG. 2, the horizontal axis denotes a voltage and the vertical axis denotes a current.

The initial field emission current $I_{e1}$ and the degraded field emission current $I_{e2}$, of the field emission device for $V_{ac}$ are the same as ones of FIG. 2. The initial field emission current $I_{e1}$ and the degraded field emission current $I_{e2}$ increase exponentially when $V_{ac}$ becomes equal to or greater than a predetermined threshold voltage.

In a state where the gate voltage $V_g$ of the current controlling transistor 12, the drain-source current $I_{ds}$ of the current controlling transistor 12 for $V_{ac}$ is the same as illustrated. When $V_{ds}$ increases, the drain-source current $I_{ds}$ is not saturated and is increased as illustrated.

Accordingly, when the field emission current function of the field emission device 11 changes $I_{e1}$ to $I_{e2}$, the current emission current also changes $I_1$ to $I_2$ and is not maintained to be constant. Also, since the electric field emission system 10 is controlled with a single current controlling transistor 12, a saturation region of the current controlling transistor 12 may not be generated in a necessary current region.

Figure 4:
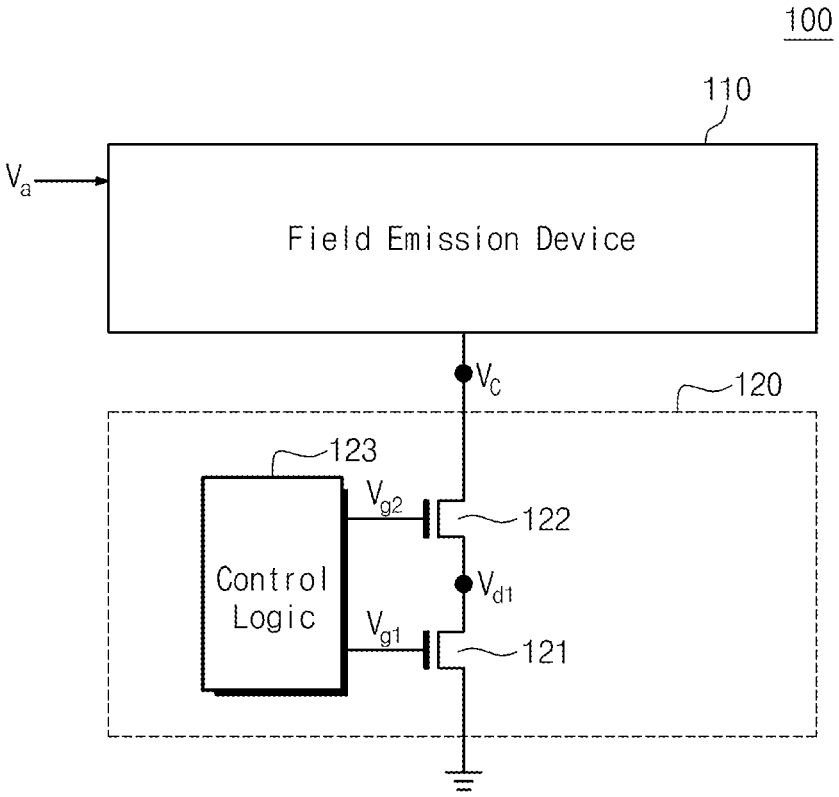
FIG. 4 is a block diagram illustrating an improved filed emission system, according to the present invention.

FIG. 4 is a block diagram illustrating an improved electric field emission system according to the present invention. Referring to FIG. 4, the electric field emission system 100 includes an electric field emission device 110 and a current controlling device 120.

The electric field emission system 100 may maintain the field emission current to be constant using a plurality of transistors which are connected in series and included in the current controlling device 120, even though an electric field emission current function changes. In addition, the electric field emission system 100 may adjust an electric field emission current level to a desired current level using the current controlling device 120.

The current emission device 110 includes a cathode for emitting electrons. The current emission device 110 are the same in a configuration and operations as the field emission device 11 of FIG. 1.

The current controlling device 120 includes a first current controlling transistor 121, a second current controlling transistor 122 and a control logic 123. The first current controlling transistor 121 and the second current controlling transistor 122 are connected to the cathode of the current emission device 110 in series. The first current controlling transistor 121 and the second current controlling transistor 122 may be a Power MOSFET for tolerating a high voltage. In particular, the first current controlling transistor 121 may be a depletion mode MOSFET or an enhancement mode MOSFET. However, the first current controlling transistor 121 and the second current controlling transistor 122 according to the present invention are not limited thereto.

FIG. 4 illustrates only the first current controlling transistor 121 and the second current controlling transistor 122, but the number of current controlling transistors included in the current controlling device 120 is not limited. For example, the current controlling device 120 may include 3 or more current controlling transistors connected in series.

The control logic 123 controls each node voltage of the first and second current controlling transistors 121 and 122. The control logic 123 may adjust or limit a current level of the field emission current using the first current controlling transistor 121. Also, the control logic 123 may maintain the field emission current to be constant using the first and second current controlling transistors 121 and 122 together. At this time, the voltage $V_a$ applied to the field emission device is necessary to be sufficiently high so that a level of the current to be emitted is equal to or higher than a desired current level.

The control logic 123 provides a first gate voltage $V_{g1}$ to the gate of the first current controlling transistor 121. The source of the first current controlling transistor 121 is connected to the ground and the drain thereof is connected to source of the second current controlling transistor 122. The drain-source current of the first current controlling transistor 121 is determined in response to the gate voltage $V_{g1}$ and drain voltage $V_{d1}$ of the first current controlling transistor 121.

The control logic 123 provides a second gate voltage $V_{g2}$ to the gate of the second current controlling transistor 122. The source of the second current controlling transistor 122 is connected to the drain of the first current controlling transistor 121 and the drain thereof is connected to the cathode of the field emission device 110. The drain-source current of the second current controlling transistor 122 is determined in response to the gate-source voltage $V_{g2}$-$V_{d1}$ and the drain-source voltage $V_c$-$V_{d1}$ of the second current controlling transistor 122.

The control logic 123 may control an amount of the field emission current using the first gate voltage $V_{g1}$. In addition, the control logic 123 may control a upper limit of the drain node of the first current controlling transistor 121 using the second gate voltage $V_{g2}$.

Hereinafter, a current control method of the electric field emission system 100 by the control logic 123 will be described in detail with reference to FIG. 5.

Figure 5:
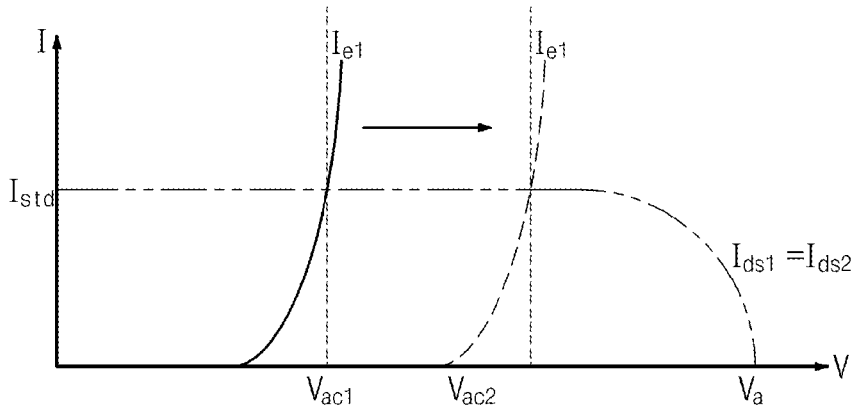
FIG. 5 is a graph illustrating a method of controlling an electric field emission current of the electric field emission system of FIG. 4.

FIG. 5 is a graph illustrating the field emission current control method of the electric field emission system of FIG. 4. In FIG. 5, the horizontal axis denotes a voltage, and the vertical axis denotes a current.

Referring to the block diagram of FIG. 4, the applied voltage $V_a$ of the field emission device 110 is distributed to an electric field emission voltage (hereinafter $V_{ac}$) of the field emission device 110, the drain-source voltage (hereinafter $V_{ds2}$) of the second current controlling transistor 122 and the drain-source voltage (hereinafter $V_{ds1}$) of the first current controlling transistor 121.

The initial field emission current $I_{e1}$ and the degradation field emission current $I_{e2}$ of the field emission device 110, with respect to the field emission voltage $V_{ac}$ of the field emission device 110 (see FIG. 4) of FIG. 5, are the same as the ones of FIGS. 2 and 3. The initial field emission current $I_{e1}$ and degradation field emission current $I_{e2}$ increase exponentially when $V_{ac}$ becomes equal to or greater than a predetermined threshold voltage.

Since the field emission device 110 and the first and second current controlling transistors 121 and 122 are connected in series, the field emission current and the drain-source currents $I_{ds1}$ and $I_{ds2}$ of the first and second current controlling transistors are necessary to have the same value.

Meanwhile, the drain-source current of the serially connected first and second current controlling transistors 121 and 122 exhibits a form identical to an ideal drain-source current of a single current controlling transistor. Accordingly, the field emission current may be maintained to be constant despite of degradation of the field emission device 110 of the electric field emission system 100 of FIG. 4. Hereinafter, an operation of the electric field emission system 100 at the time of degradation of the field emission device 110 will be described in detail.

When the field emission device 110 is degraded, $V_{ac}$ is necessary to increase in order to provide an identical electrical emission current. Since the applied voltage $V_a$ is provided constantly, the cathode voltage $V_c$ is necessary to be lowered in order to provide an identical electrical emission current.

The cathode voltage $V_c$ is distributed to the drain-source voltages of the first and second current controlling transistors 121 and 122. Since the drain voltage of the first current controlling transistor 121 is maintained to be lower than the second gate voltage $V_{g2}$ due to the second current controlling transistor 122, most of the cathode voltage $V_c$ is distributed to the drain-source voltage of the second current controlling transistor 122.

When the second gate voltage $V_{g2}$ is provided in a constant level, the drain voltage of the first current controlling transistor 121 is fixed to a constant level by the second gate voltage $V_{g2}$, even though the cathode voltage $V_c$ is changed due to degradation of the field emission device 110. At this time, the second gate voltage $V_{g2}$ is provided for the second current controlling transistor 122 to operate in a full ON state.

Accordingly, since the drain voltage of the first current controlling transistor 121 is fixed, the drain-source currents of the first and second current controlling transistors 121 and 122 are limited by the first current controlling transistor 121 and the value thereof depends on the gate voltage $V_{g1}$ of the first current controlling transistor 121.

As described above, when the field mission device 110 is degraded, the field emission current function for $V_{ac}$ changes and the cathode voltage $V_c$ may be changed. However, due to the saturation characteristics of the first and second current controlling transistors 121 and 122, the field emission current may be maintained a constant value $I_{std}$ by the first current controlling transistor 121. Accordingly, the electric field emission system 100 of FIG. 4 may maintain the field emission current to be constant despite of degradation of the field emission device 110. In an embodiment, when the second gate voltage is set so that the first current controlling transistor operates in a saturated region, the current control characteristic may be further enhanced At this time, the applied voltage $V_a$ is necessary to be sufficiently high so that the field emission voltage $V_{ac}$ increases to a level in which the above-described operation is possible. Since a difference between the applied voltage $V_a$ and the field emission voltage $V_{ac}$ is distributed mostly to the second current controlling transistor 122, an upper limit of the applied voltage $V_a$ may be determined by an allowable drain-source voltage of the second current controlling transistor 122.

The source of the first current controlling transistor 121 is connected to the ground in FIG. 4. This is an exemplary case, but a bias condition according to the present invention is not limited thereto. For example, a negative voltage may be applied to the source of the first current controlling transistor 121. In response to this, the gates of the first and second current controlling transistors 121 and 122 will be provided with a voltage higher than the source voltage.

Figure 6:
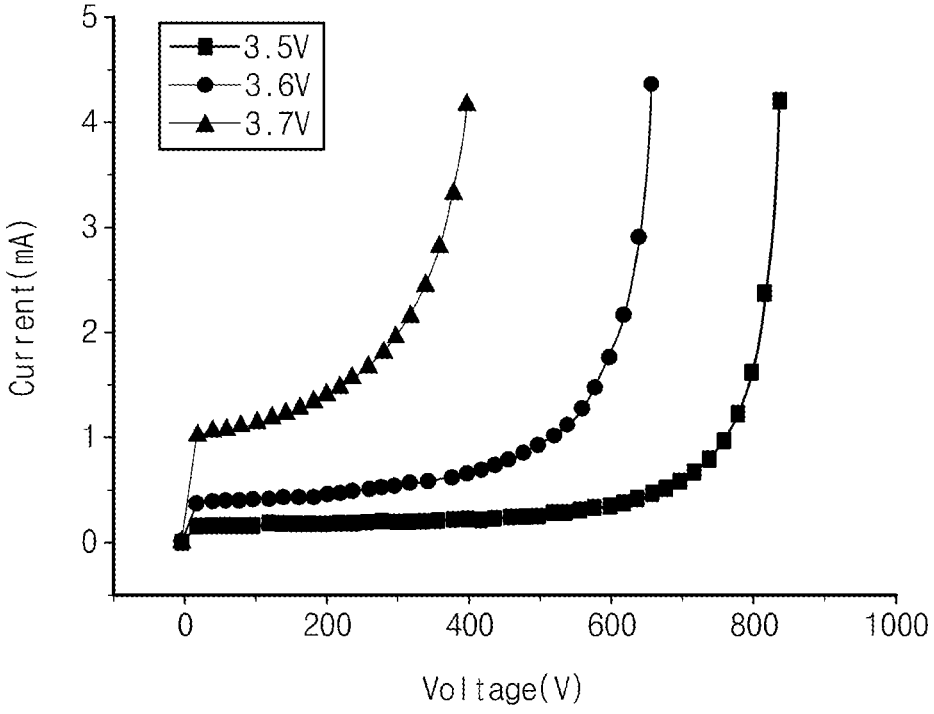
FIG. 6 is a graph illustrating operation results of the electric field emission system of FIG. 1.
Figure 7:
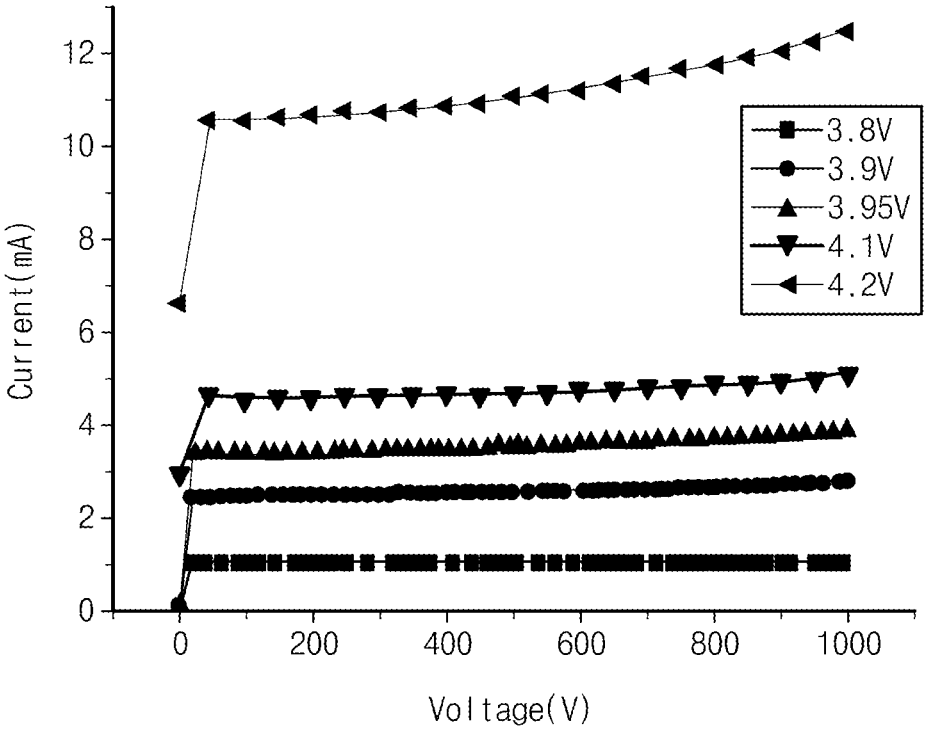
FIG. 7 is a graph illustrating operation results of the electric field emission system of FIG. 4.

FIG. 6 is a graph illustrating operation results of the current controlling transistor 12 in FIG. 1. FIG. 7 is a graph illustrating operation results of the field control device 120 in FIG. 4. In FIGS. 6 and 7, the horizontal axis denotes a voltage and the vertical axis denotes a current.

The graphs of FIG. 6 represent a drain-source current vs. a drain voltage when the gate voltage is 3.5V, 3.6V and 3.7V. As illustrated, the lower the drain voltage provided to the current controlling transistor is, the field emission current value is maintained to be stable despite of a change of the drain voltage. However, when the voltage applied to the field emission device increases to a predetermined level or more, the drain-source current is not maintained to be constant and increases rapidly.

The graphs of FIG. 7 exhibit an electric field emission current with respect to the applied voltage when the gate voltage of the first current controlling transistor is 3.8V, 3.9V, 2.95V, 4V and 4.2V. When the drain voltage grater than the one in FIG. 1 is provided, the drain-source current is maintained to be constant, even though the applied voltage increases to 1000V or more. In addition, the constant value may be confirmed to be controlled using the gate voltage of the first current transistor.

When the drain voltage has a predetermined level or more in FIG. 7, the field emission current slightly increases. This is a phenomenon caused by heating of the first and second current controlling transistors. When a heat sink is attached, more stable characteristics may be exhibited.

Figure 8:
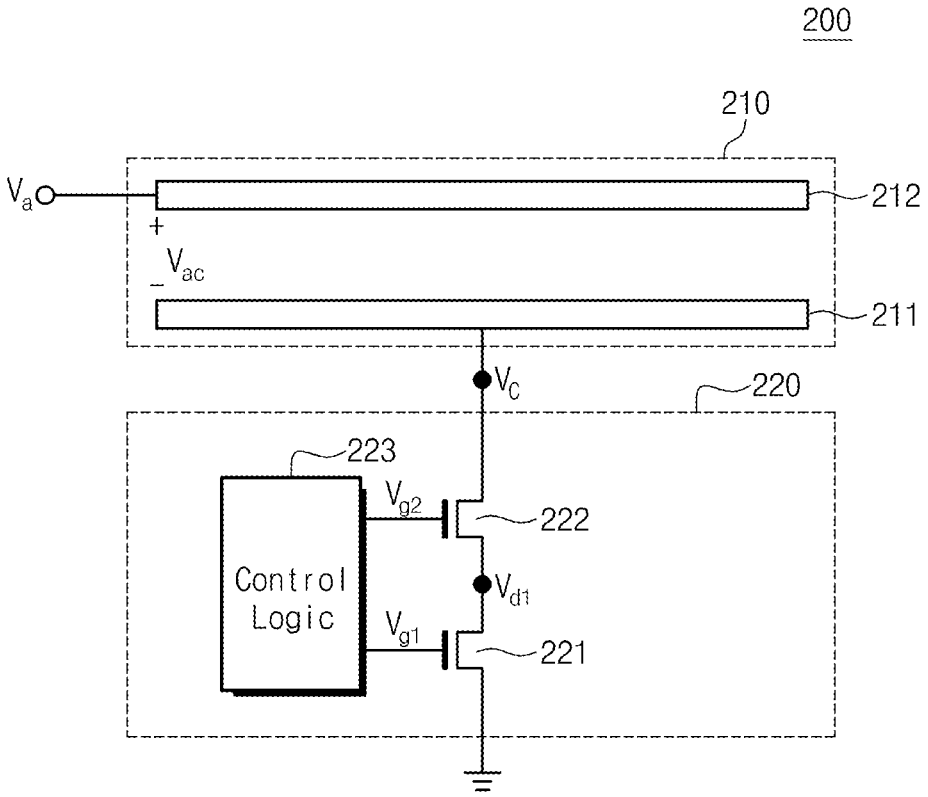
FIG. 8 is a circuit diagram illustrating an electric field emission display to which a electric field emission system according to the present invention is applied.

FIG. 8 is a block diagram illustrating an embodiment where the electric field emission system according to the present invention is applied to an electric field emission display. The field emission display 200 includes an electric field emission display module 210 and a current controlling device 220.

The field emission display module 210 includes a cathode 211 and an anode 212. The field emission display module 210 generates a light according to a voltage difference between the cathode 211 and the anode 212. The field emission display module 210 of the present embodiment is illustrated as a dipole structure, but is not limited thereto. For example, the field emission display module 210 may further include a gate and generate a light according to a voltage difference between the gate and the cathode.

The anode 212 includes a fluorescent body for generating a light. When the fluorescent body of the anode 212 collides with electrons, electrons in the fluorescent body are separated from and the light is generated.

The anode 212 is provided with the applied voltage $V_a$ in order to induce the electrons. The applied voltage $V_a$ has a greater positive value than a voltage of the cathode 211.

The current controlling device 220 includes a first current controlling transistor 221, a second current controlling transistor 222 and a control logic 223.

As described above, the control logic 223 may control the gate voltages of the first and second current controlling transistors 221 and 222. The control logic 223 may adjust or limit a current level of the field emission current using the first gate voltage $V_{g1}$ provided to the first current controlling transistor 221. In addition, the control logic 223 may maintain the field emission current to be constant using the first and second current controlling transistors 221 and 222.

The current controlling device 220 according to the present invention may adjust or limit a current level of the field emission current using the control logic 223. Also, the current controlling device 220 may control the intensity of the light generated in the field emission display module 210 by maintaining the level of the field emission current to be constant.

Figure 9:
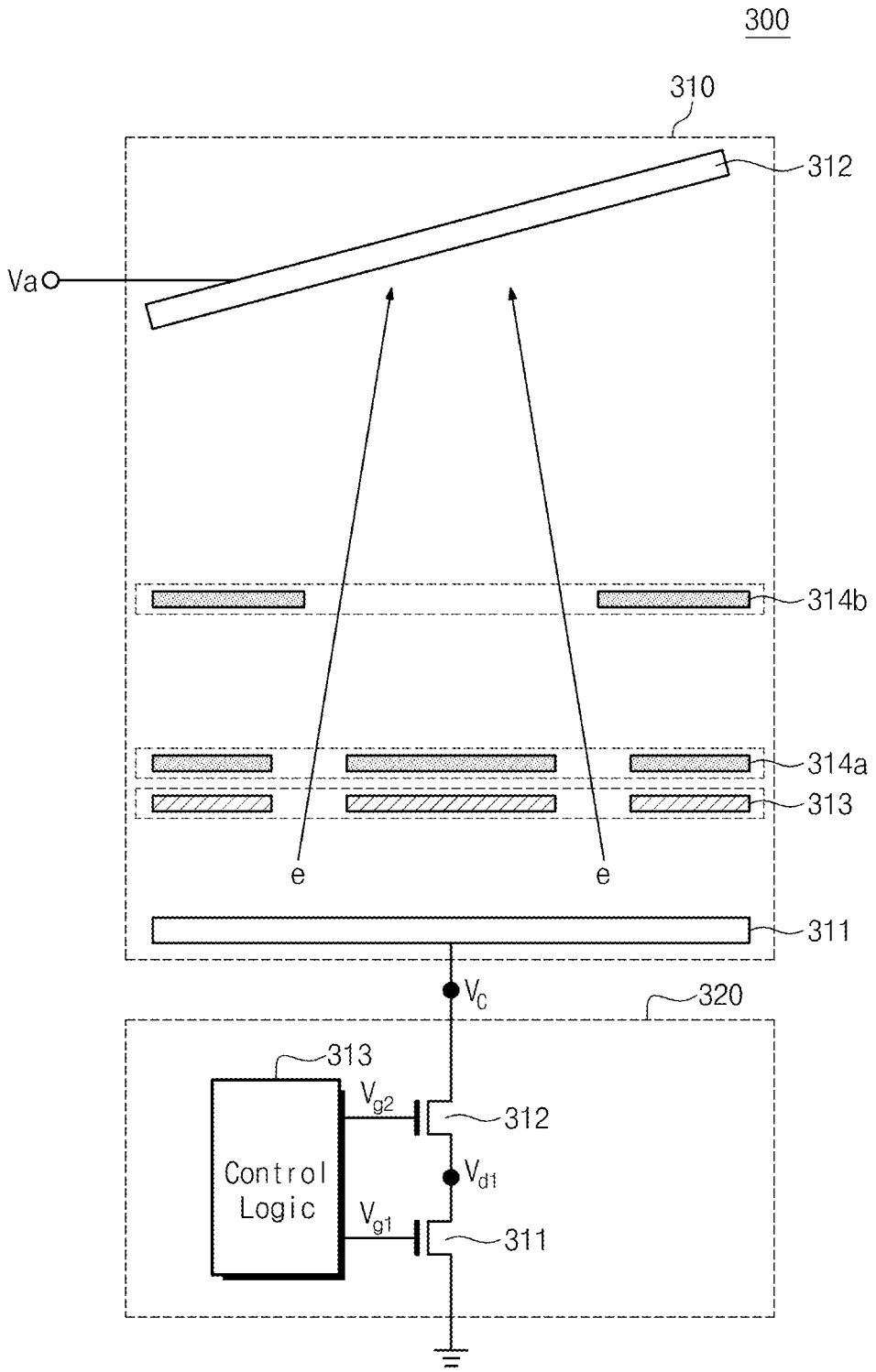
FIG. 9 is a view illustrating an embodiment that a electric field emission system according to the present invention is applied to an electric field emission X-ray source.

FIG. 9 is a block diagram illustrating an embodiment where the electric field emission system according to the present invention is applied to an X-ray source. The field emission X-ray source 300 includes an electric field emission X-ray device 310 and a current controlling device 320.

The field emission X-ray device 310 includes a cathode 311, an anode 312, a gate 313, a first focusing electrode **314*a* and a second focusing electrode 314*b***.

The cathode 311 includes a Carbon Nanotube (CNT) emitter. When a great voltage difference occurs between the cathode 311 and the anode 212, or the cathode 311 and the gate 312, electrons are emitted from the CNT emitter. The electrons emitted from the cathode 311 pass the gate 313, the first focusing electrode 314*a* and the second focusing electrode, and then are focused on the anode 312.

The gate 313 is a plate having a mesh type where a plurality of gate holes are formed. The gate 313 induces electron emission from the cathode 311. Also, the first focusing electrode 314*a* and the second focusing electrode 314*b* prevent diffusion of the electrons emitted from the cathode 311 and induce the electrons to be focused on the anode 312. In the anode 312, an X-rays is generated by the focused electrons which are emitted from the cathode 313 and focused.

When the field emission X-ray source 300 operates, it is important to maintain a magnitude of the generated X-ray to be constant. However, on operation of the field emission X-ray source 300, a distance between the cathode 312 and the gate 313 is not maintained to be constant and varied due to physical vibration of the gate 313 of the field emission X-ray device 310. The magnitude of the X-ray varies in response to the variation of the distance between the cathode 312 and the gate 313.

The field emission X-ray source 300 according to the present invention may control the field emission current flowing through the field emission X-ray module 310 using the current controlling device 320. The field emission X-ray source 300 may maintain magnitude of the X-ray generated from the field emission X-ray device 310 to be constant by maintaining the field emission current to be constant.

The current controlling device 320 includes a first current controlling transistor 321, a second current controlling transistor 322 and a control logic 323.

As described above, the control logic 323 may control the gate voltages of the first and second current controlling transistors 321 and 322. The control logic 323 may adjust or limit a current level of the field emission current using the first gate voltage $V_{g1}$ provided to the first current controlling transistor 321. Also, the control logic 323 may maintain the field emission current to be constant using the first and second current controlling transistors 321 and 322.

The current controlling device 320 according to the present invention may adjust or limit the field emission current. Also, the current controlling device 320 may maintain the magnitude of the X-ray generated in the field emission X-ray source 310 to be constant by maintaining a level of the field emission current to be constant.

Figure 10:
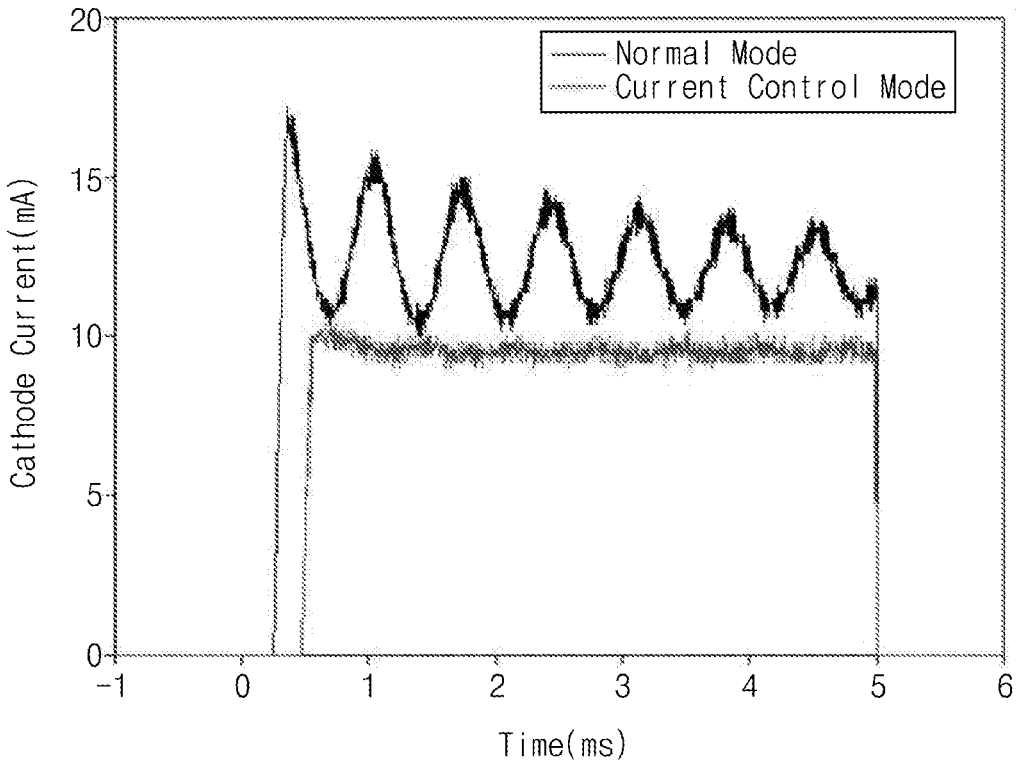
FIG. 10 is a graph illustrating operations of field emission X-ray sources to which the present invention is applied and the present invention is not applied.

FIG. 10 is a graph illustrating operation results of the field emission X-ray source 300 to which the present invention is applied and an electric field emission X-ray source to which the present invention is not applied. Referring to FIG. 10, it can be seen that the magnitude of X-ray of a typical field emission X-ray source vibrates as the time changes, while the magnitude of X-ray of the X-ray emission X-ray source according to the present invention is maintained to be constant.

According to the current controlling device and the electric field emission system including the same according to the present invention, the field emission current can be maintained to be constant. Also, a level of the field emission current, which is maintained to be constant, can be set to a desired value.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A current controlling device for controlling an electric field emission current in connection with an electric field emission device which emits electrons in response to an applied voltage, the current controlling device comprising:

a first current controlling transistor defining a first current path in response to a first gate voltage, the first gate voltage being provided to a gate of the first current controlling transistor;

a second current controlling transistor connected in series between the field emission device and the first current controlling transistor, the second current controlling transistor defining a second current path in response to a second gate voltage, the second gate voltage being provided to a gate of the second current controlling transistor; and a control logic controlling the first and second gate voltages, wherein the control logic controls an upper limit of the field emission current by using the first gate voltage, and wherein the control logic maintains the field emission current at a constant level when the field emission device is operating.

2. The current controlling device according to claim 1, wherein the current controlling device is driven under a condition that the applied voltage is provided with a value equal to or greater than a reference voltage, and wherein the reference voltage induces the electric field emission current equal to or greater than the upper limit of the field emission current from the field emission device.

3. The current controlling device according to claim 2, wherein the current controlling device is driven under a condition that the applied voltage is provided with a value equal to or lower than an upper limit voltage, and wherein the upper limit voltage is determined on the basis of a characteristic of the field emission device and an allowable drain-source voltage of the second current controlling transistor.

4. The current controlling device according to claim 1, wherein the control logic controls the second gate voltage so that the second current controlling transistor is only in a turn-on state when the current controlling device is operating.

5. The current controlling device according to claim 4, wherein the control logic controls the second gate voltage to be constant and higher than the first gate voltage.

6. The current controlling device according to claim 4, wherein the control logic controls the second gate voltage to cause the first current controlling transistor to operate in a saturated region.

7. The current controlling device according to claim 1, wherein the second current controlling transistor is a power metal oxide semiconductor field-effect transistor (Power MOSFET).

8. The current controlling device according to claim 1, wherein the first current controlling transistor is a depletion mode Power MOSFET or an enhance mode Power MOSFET.

9. The current controlling device according to claim 1, wherein the first and second current controlling resistors are attached to a heat sink.

10. An electric field emission system comprising:

an electric field emission device including a cathode configured to emit electrons in response to an applied voltage; and a current controlling device connected in series to the field emission device, the current controlling device configured to control an electric field emission current, wherein the current controlling device comprises:

a first current controlling transistor defining a first current path in response to a first gate voltage, the first gate voltage being provided to a gate of the first current controlling transistor;

a second current controlling transistor connected in series between the cathode and the first current controlling transistor and defining a second current path in response to a second gate voltage, the second gate voltage being provided to a gate of the second current controlling transistor; and a control logic controlling the first and second gate voltages, wherein the control logic controls an upper limit of the field emission current by using the first gate voltage, and wherein the control logic maintains the field emission current at a constant level when the electric field emission device is operating.

11. The system according to claim 10, wherein the field emission device further comprises an anode receiving the electrons, and wherein the electrons are emitted according to a voltage difference between the anode and the cathode.

12. The system according to claim 11, wherein the anode comprises a fluorescent body for generating a light, and generates the light in response to the received electrons.

13. The system according to claim 11, wherein the anode generates X-rays in response to the received electrons.

14. The system according to claim 10, wherein the field emission device further comprises:

an anode receiving the electrons; and a gate located between the anode and the cathode and inducing electron emission, and wherein the electrons are emitted according to a voltage difference between the gate and the cathode.

15. The system according to claim 14, wherein the field emission device further comprises a focusing electrode focusing the electrons emitted from the cathode, and wherein the focusing electrode is located between the gate and the anode.

16. The system according claim 10, wherein the applied voltage is equal to or greater than a reference voltage, and wherein the reference voltage induces the electric field emission current equal to or greater than the upper limit of the field emission current from the field emission device.

17. The system according to claim 16, wherein the applied voltage is equal to or lower than an upper limit voltage; and the upper limit voltage is determined on the basis of a characteristic of the field emission device and an allowable drain-source voltage of the second current controlling transistor.

18. A field emission X-ray device, comprising:

an X-ray device, including:

a cathode configured to emit electrons toward an anode;

the anode spaced apart from the cathode, the anode being configured to emit x-rays when the anode receives the emitted electrons;

a first focusing electrode located between the cathode and the anode;

a second focusing electrode located between the anode and the first focusing electrode; and a gate located between the first focusing electrode and the cathode, the gate including a plurality of holes, the gate being configured to focus the electrons; and a current controlling device including:

a first transistor defining a first current path in response to a first gate voltage, the first gate voltage being provided to a gate of the first transistor;

a second transistor coupled in series between the first transistor and the anode of the X-ray device, the second transistor defining a second current path in response to a second gate voltage, the second gate voltage being provided to a gate of the second transistor; and a control logic controlling a gate voltage of each of the first and second transistors, the control logic being configured to maintain a constant current flowing through the X-ray device when the X-ray device is operating, wherein each of the emitted electrons passes through the first focusing electrode, the second focusing electrode, and the gate before being received by the anode.

19. The field emission X-ray device of claim 18, wherein the cathode includes a carbon nanotube (CNT) emitter.

20. The field emission X-ray device of claim 18, wherein the first and second focusing electrodes are configured to focus the emitted electrodes onto the anode.

* * * * *